US007000258B1

(12) United States Patent
Nunally

(10) Patent No.: US 7,000,258 B1
(45) Date of Patent: Feb. 21, 2006

(54) PULLING GLOVE

(76) Inventor: William Anthony Nunally, 1705 Bluebird La., Vinton, LA (US) 70668

( * ) Notice: Subject to any disclaimer, the term of this patent is extended or adjusted under 35 U.S.C. 154(b) by 0 days.

(21) Appl. No.: 10/944,396

(22) Filed: Sep. 20, 2004

(51) Int. Cl.
*A41D 19/00* (2006.01)

(52) U.S. Cl. ..... 2/160; 66/161.6

(58) Field of Classification Search ..... 2/160, 2/161.6, 159, 161.1, 169; D2/610, 612, 614, D2/621; 294/1.1, 25
See application file for complete search history.

(56) References Cited

U.S. PATENT DOCUMENTS 2,437,886 A 3/1948 Millard et al.
3,417,840 A * 12/1968 Farnsworth, Jr. ..... 2/160
3,541,990 A * 11/1970 Mas ..... 441/69
4,574,398 A 3/1986 Endo et al.
4,606,484 A * 8/1986 Winter et al. ..... 224/218
4,651,351 A 3/1987 Endo et al.
4,805,238 A 2/1989 Crafts
5,110,154 A * 5/1992 Street ..... 2/160
D351,933 S * 11/1994 Stoneman ..... 2/160
5,471,681 A * 12/1995 Ferrini ..... 2/160
5,715,539 A 2/1998 Benecki et al.
5,779,292 A * 7/1998 Kasday ..... 294/25
5,853,210 A * 12/1998 Robinson ..... 294/25

* cited by examiner

*Primary Examiner*—Danny Worrell
(74) *Attorney, Agent, or Firm*—Richard L. Mikesell

(57) ABSTRACT

A glove suitable for pulling wire rope or cable without putting point or line pressure on the hand of the user is disclosed. The glove has a cleat affixed to the palm of the glove.

2 Claims, 1 Drawing Sheet

PULLING GLOVE

BACKGROUND OF THE INVENTION

The present invention generally relates to a glove designed specifically for use when pulling on a cable, rope, bar, or the like. As with all work gloves, it is designed to protect the user's hand(s), but in this instance is designed to provide specific protection to the tender palms when the gloved hand is grasping a round surface, and exerting pulling force. This sort of protection is most useful, for instance, when the user is pulling on a wire cable.

OBJECTS OF THE INVENTION

It is an object of the invention to provide protection for the user's hands.

It is a further object of the invention to provide special protection to the palms of the user's hands.

It is a still further object of the invention to provide protection to the palms of the user's hands when the user is pulling on a hard round object, such as a wire rope, by closing his hand about it and exerting force either towards or, in the case of a rigid bar, away from himself.

BRIEF DESCRIPTION OF THE DRAWINGS

Turning now to the drawings.

SUMMARY OF THE INVENTION

Figure 1:
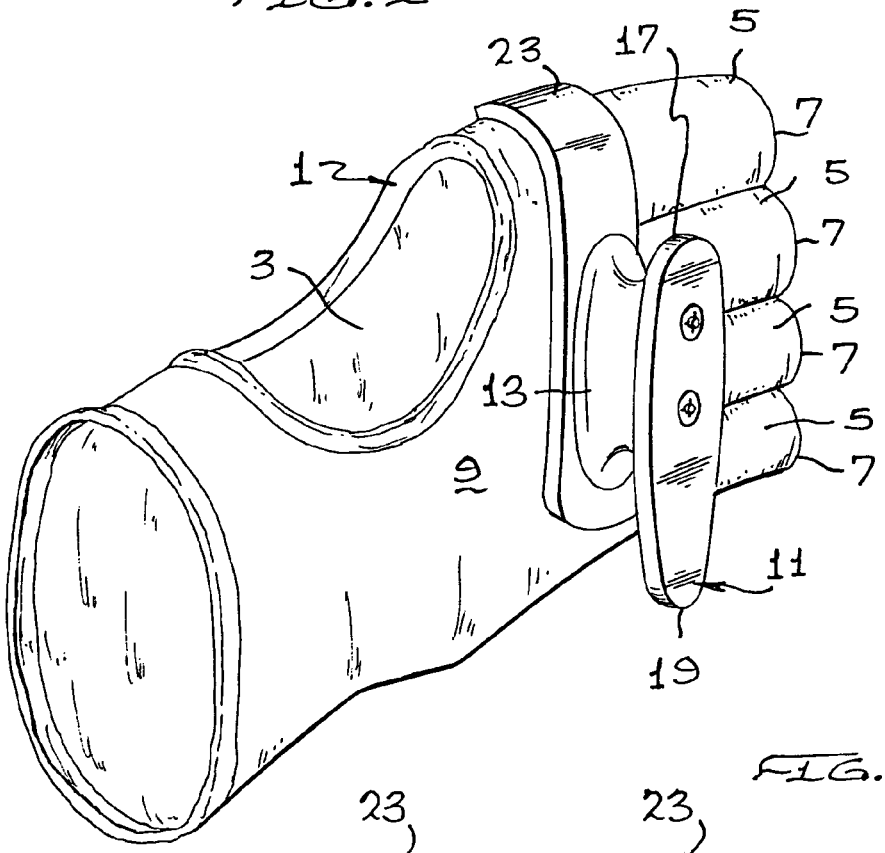
FIG. 1 is a perspective view of a typical glove of the instant invention.

The glove of the instant invention is in many respects similar to typical work gloves, being of sturdy construction, and encasing as much of the user's hand as is necessary. That is, it could be thumbless (as shown in FIG. 1), or have the ends of the fingers open (as also shown in FIG. 1), or it may be either, or neither. The inventive characteristic of the glove is the palm-mounted cleat. The cleat shown is typical, but the particular configuration of the cleat may vary within the scope of the invention.

It can be seen that in use, the grasped object, for instance a cable or rope (not shown) would nest against the working surface of the cleat (the rear in the case of pulling, and the front in the case of pushing), thereby allowing the user to exert force on the grasped object without having that force transferred directly to his palm, as would be the case with a cleatless glove. In the case, for instance, of small diameter wire rope, this allows the exertion of much more force than is possible with an ordinary glove, inasmuch as the cleat is taking the pressure from the small diameter rope, and spreading that pressure over the entire palm of the hand, as opposed to the force being concentrated on the palm of the hand directly in contact with the rope. Further advantages and variants will become clear from the following more detailed description.

DETAILED DESCRIPTION OF THE INVENTION AND OF THE PRESENTLY PREFERRED EMBODIMENT

Figure 2:
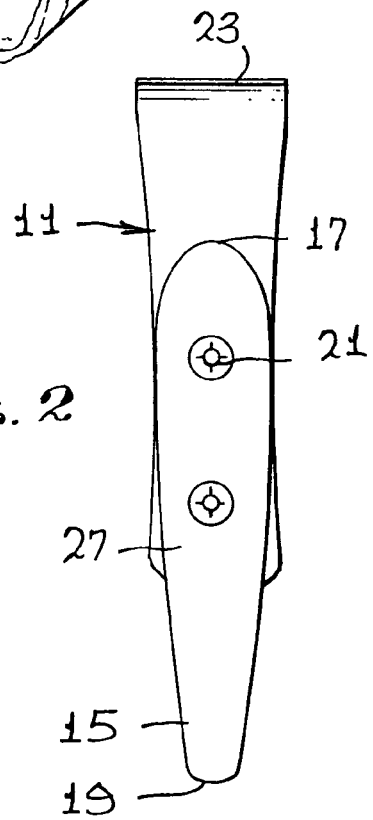
FIG. 2 is a top plan view of a typical unmounted cleat of the instant invention, being a top view of the mounted cleat shown in FIG. 1
Figure 3:
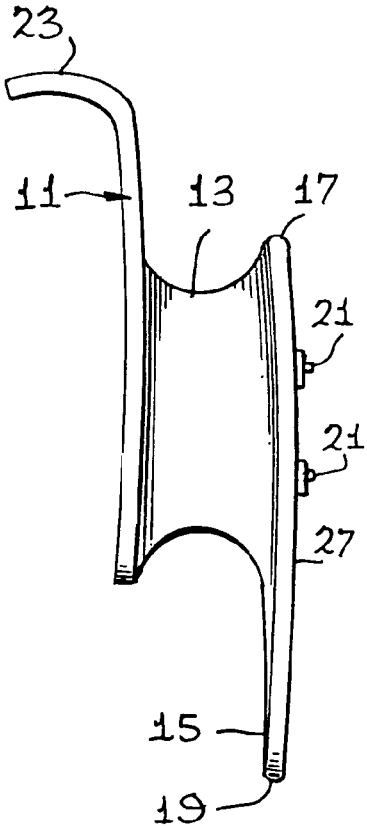
FIG. 3 is a side elevation of a typical unmounted cleat of the instant invention, being a side view of the typical cleat of FIG. 1 and FIG. 2.

Referring now to the Drawings, FIG. 1 shows a glove 1 of the instant invention. In the preferred embodiment, the glove 1 does not have a thumb, but rather an opening 3 for the thumb to protrude. This opening 3 allows the user to have greater dexterity than if the thumb were covered by thumb piece on the glove. Similarly, the fingers are not completely covered, but rather are partially covered by finger portions 5 which have openings 7 for the tips of the fingers to protrude. The glove is of a heavy fabric, plastic, or leather, the preferred embodiment being leather. In the palm 9 of the glove, a cleat 11 is affixed. In the preferred embodiment, the cleat 11 has a groove 13 about its circumference. The groove 13 may be of any diameter, but it has been found that about one-half inch is most suitable. The cleat has an extension 15 on one or both ends, only one being shown in FIG. 1. That extension or extensions allows, for instance, the user to wind a flexible rope about the cleat, thereby locking it to the glove. Or, whether the rope is wound or just crosses the top end 17 or bottom end 19 of the cleat, the user can exert upwards or downwards force on the rope or cable. It is preferred that the cleat 11 be of sturdy construction, steel being preferred. The cleat 11 is affixed to the glove by attachment means 21. In the preferred embodiment, the attachment means are bolts. FIG. 2 shows a typical cleat 11. Again, only one extension or horn is illustrated, but two, one at each end 17 or 19 of the cleat may be provided. Also shown is a mounting strap 23 to which the cleat 11 is affixed by attachment means 21. The mounting strap is again of a sturdy material, but the preferred embodiment is of leather. The two attachment means pass through holes in the cleat 11, through corresponding holes in the strap 23, and through other corresponding holes in the glove 1. In the preferred embodiment, the mounting means has a smooth or flush surface on the interior of the glove 1, such that the user does not have point pressure on his palm. The preferred embodiment is T nuts through the palm of the glove and the mounting strap 23, and a through bolt 21 going through the cleat 11 and mounting strap 23 and into the T nuts, such that both the bolt and the nut are flush with their mounting surface beneath the cleat 11 and the mounting strap 17 and the planar top surface 27 of the cleat 11.

Although several embodiments of the present invention have been described in detail for purposes of illustration, various modifications of each may be made without departing from the spirit and scope of the invention. Accordingly, the invention is not to be limited, except as by the appended claims.

I claim:

1. A hand glove comprising:

A surface covering the palm of the hand of the wearer; and

A cleat mounted with its long axis parallel to the hand opening in the glove on the external surface of the palm covering; and the cleat is grooved about its circumference parallel to the external surface of the palm covering.

2. The glove of claim 1 wherein the cleat has at least one protruding end horn on the top surface of the cleat.

* * * * *